US005417409A

United States Patent [19]

Reddell

[11] Patent Number: 5,417,409

[45] Date of Patent: May 23, 1995

[54] VISE WITH SLIDING BACK JAW

[76] Inventor: Glen R. Reddell, 2621 Marion St. SE., Albany, Oreg. 97321

[21] Appl. No.: 224,659

[22] Filed: Apr. 6, 1994

[51] Int. Cl.[6] ..... B25B 1/24

[52] U.S. Cl. ..... 269/25; 269/27; 269/69; 269/100; 269/88; 269/211; 269/208; 269/212

[58] Field of Search ..... 269/25, 27, 32, 69, 269/95, 99, 100, 88, 208, 82, 211

[56] References Cited

U.S. PATENT DOCUMENTS

| | | | |
|---|---|---|---|
| 1,114,970 | 10/1914 | Cumner | 269/211 |
| 1,659,302 | 2/1928 | Reinhardt | 269/69 |
| 2,683,386 | 7/1954 | Doebeli | 269/32 |
| 4,363,475 | 12/1982 | McCarty | 269/69 |
| 4,413,818 | 11/1983 | Lenz . | |
| 4,685,661 | 8/1987 | Slocum . | |
| 4,736,935 | 4/1988 | Vasapolli . | |
| 4,789,146 | 12/1988 | Kuei | 269/69 |
| 4,968,012 | 11/1990 | Haddad . | |
| 5,098,073 | 3/1992 | Lenz . | |
| 5,110,098 | 5/1992 | Merjanian . | |
| 5,133,536 | 7/1992 | Goodman | 269/25 |
| 5,149,071 | 9/1992 | Oliveira . | |
| 5,156,382 | 10/1992 | Saeda . | |

FOREIGN PATENT DOCUMENTS

| | | |
|---|---|---|
| 0432019 | 6/1991 | European Pat. Off. . |
| 2595062 | 9/1987 | France . |
| 0795863 | 1/1981 | U.S.S.R. . |
| 0831496 | 5/1981 | U.S.S.R. . |
| 0865598 | 9/1981 | U.S.S.R. . |

*Primary Examiner*—Robert C. Watson

[57] ABSTRACT

A vise including a body 30 comprising a way 31 integrally formed to a rear column of support 35, a housing 46 attached below way 31, a front column of support 32, and a front jaw 34 attached to the upper portion of column 32. Front jaw 34 having a pad 82 with a clamping surface 83 facing the rear. A hydraulic jack 150 resting within housing 46 while having a ram 138 to project through an opening 33 in front column 32. Ram 138 to push a pad 64 having side arms 63 extending rearward while being tracked along the sides of housing 46. Side arms 63 being attached by hinge to side arms 76 which are joined to a drawbar 75. A carriage 52 being capable of sliding and reversing on way 31. Carriage 52 having a back jaw 54 which has two jaw pads 86 and 90 with opposing clamping surfaces 87 and 91. Carriage 52 also having gripping formations 57GF for adjustable placement of drawbar 75. Rear column 35 is attached by hinge to the rear portion of a platform 94. The front column of support 32 can be latched to the front of platform 94. Platform 94 being rotatable upon a base 106 which is mounted to a table. Vise body 30 being able to pivot to a vertical position while also having the ability to latch to platform 94 while in the vertical position. An auxiliary rack 126 may also be mounted to a table for retaining an optional clamping position beyond the front exterior of the vise.

20 Claims, 9 Drawing Sheets

43
42H
42T
43W
43RC
42
34
34MS
30
33
31H
31
36
37
38
32

31S
31TE
38B
31TE
40
35
39
31TE
31S
31
41H
41
31TE
37A
38A
40
38B 34
34MS
31H
39
35
30
33
38
37
36
32
44H
44S
44

FIG. 16
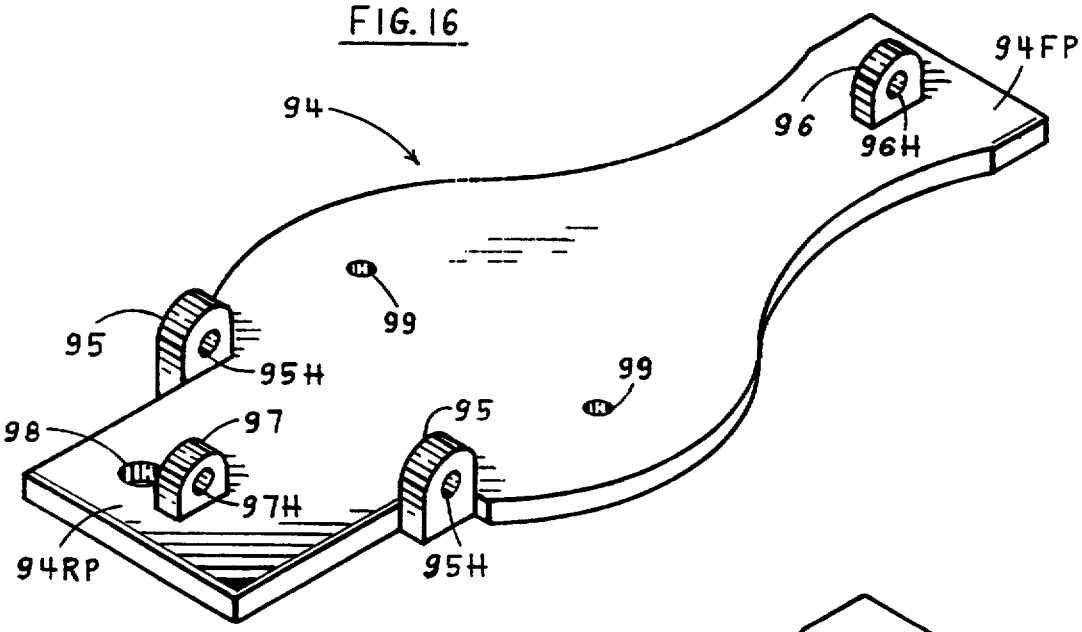
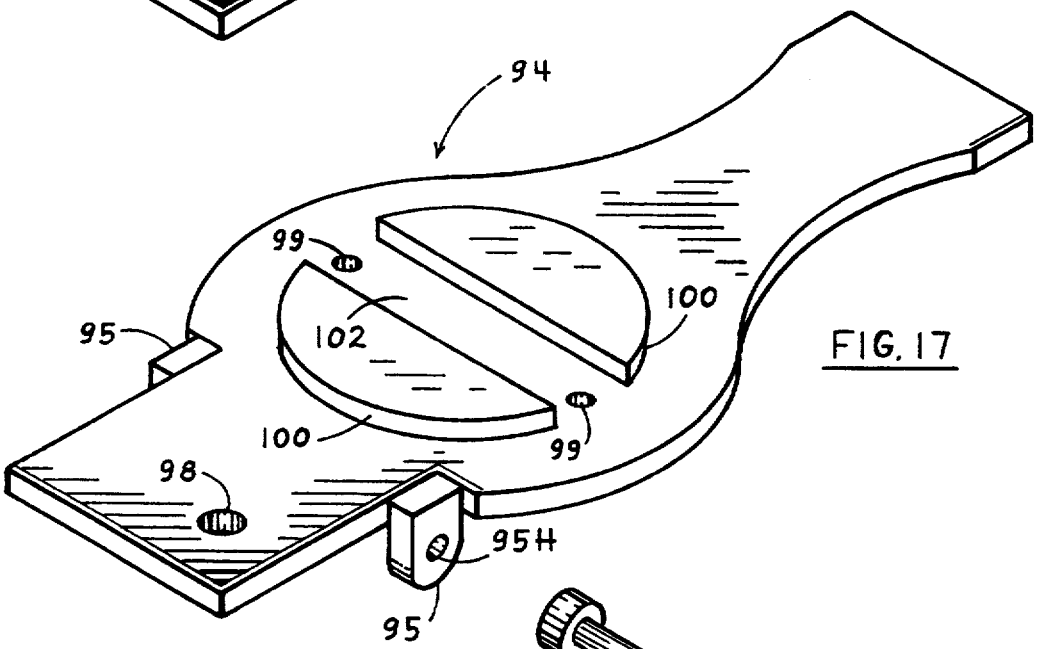
FIG. 17
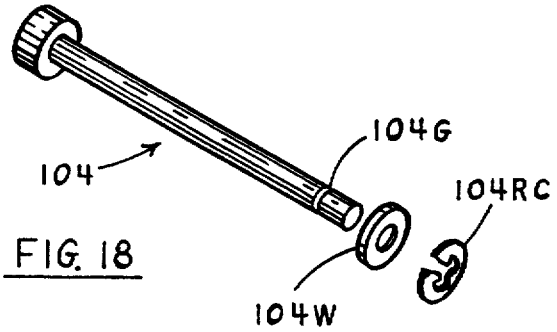
FIG. 18

FIG. 19
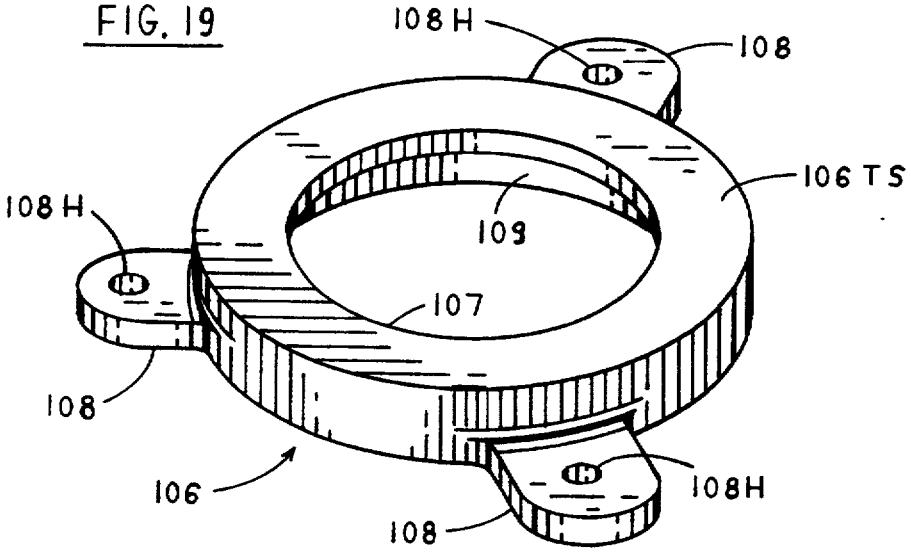
FIG. 20
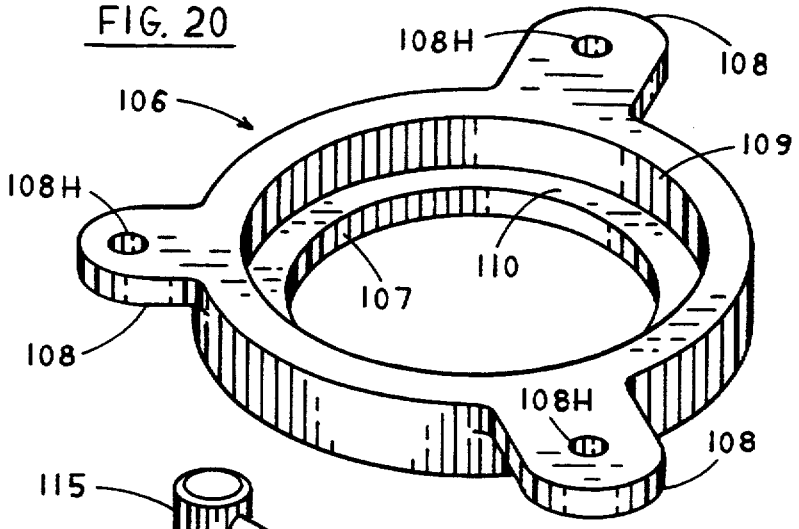
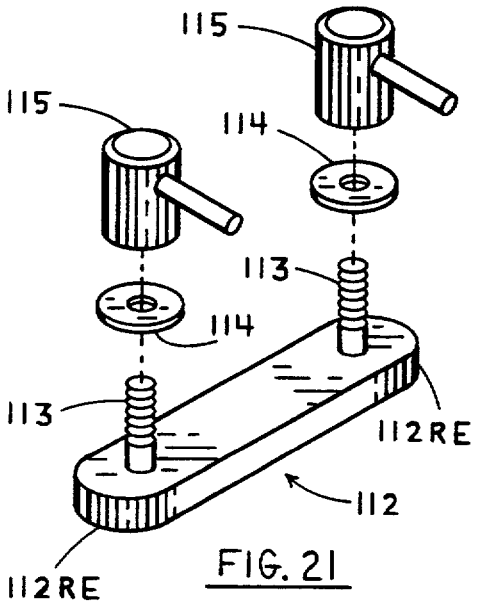
FIG. 21
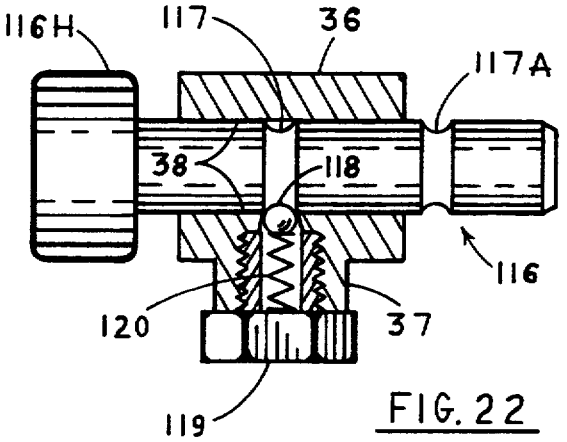
FIG. 22

VISE WITH SLIDING BACK JAW

BACKGROUND

1. Field of Invention

This invention relates to a large capacity general purpose vise that has an adjustable and extendable back jaw while also being able to be operated in a normal horizontal position or be pivoted upward to a vertical operating position.

2. Description of Prior Art

Most vises have a fixed jaw mounted upon a vise body and a movable jaw body resting within or upon the vise body while being movable by a vise screw. Other clamping devises also exist which use a piston-cylinder to directly push a movable jaw or jaws toward a fixed jaw. In either case, the clamping capacities are normally small in relation to the massive area needed to accommodate the function of the vise.

Several types of workholding devises have been presented in earlier patents. U.S. Pat. No. 4,685,661 to Slocum (1987), foreign patent SU 795863 to Shad (1981), foreign patent SU 0831496 to Ivan (1981), and foreign patent EP 0432019 A2 to Kosmek (1991) work with cylinder-pistons that directly move the workholder jaw or jaws. These clamping devises are complicated and expensive to construct. It is unlikely that devises like these could be manufactured to sell in the common market place.

U.S. Pat. No. 5,098,073 issued to Lenz (1992) shows a vise having two jaws which move simultaneously toward a fixed jaw and are operated by a vise screw. U.S. Pat. No. 5,149,071 issued to Oliveira (1992) has a pair of jaws movable toward two fixed jaws and is primarily designed to hold round objects. U.S. Pat. No. 4,413,818 issued to Lenz (1983) shows a vise having a fixed jaw and another jaw movable by a vise screw while the vise body can be clamped to a table while resting on its bottom or either of the two sides. U.S. Pat. No. 4,736,935 issued to Vasapolli shows a vise having a movable jaw body which clamps to the vise body while a first jaw is adjustable and a second jaw can be clamped and also slid on an incline of the movable jaw body. Foreign patent SU 0865598 issued to Bale (1981) shows a vise having a rotating cylinder to directly drive a movable jaw towards a fixed jaw. U.S. Pat. No. 4,968,012 issued to Haddad (1990) shows a workpiece holding apparatus for holding a workpiece in a predetermined position. U.S. Pat. No. 5,110,093 to Merjanian (1992), U.S. Pat. No. 5,156,382 to Saeda (1992), and foreign patent FR 2595062 to Rena (1987) show inventions with a means for changing the workholders mounted position. Although these prior workholding devises may work fine for their intended usages, most have characteristics which limit their uses to specific kinds of tasks and most were designed to be used primarily in machine shops or for industrial uses. These devises also suffer from a number of other disadvantages:

(a) The devises using a vise screw lack the ability to quickly adjust the movable jaw or jaws in relation to clamping workpieces.

(b) The cylinder piston operated devises are bulky and expensive to manufacture.

(c) Their maximum clamping capacities are relatively small in relation to the overall size of the devise.

(d) They lack the ability to pivot to a vertical position to change the clamping direction of their jaws.

Accordingly, this vise has been designed in a uniquely different manner for several reasons. Some of the objects and advantages of my present invention are:

(a) to provide a vise where the clamping capacities between its jaws are quickly and easily changeable;

(b) to provide a vise which has larger than normal maximum workpiece holding capacity in relation to the overall length of its body;

(c) to provide a vise having more than one clamping location;

(d) to provide a vise able to clamp objects at two locations at the same time;

(e) to provide a vise which can be changed from a horizontal to a vertical working position;

(f) to provide a lightweight yet powerful vise having a reasonably low manufacturing cost;

(g) to provide a vise requiring very little manual force to apply a great clamping force;

(h) to provide an affordable vise which has work applications suitable for normal household, building trade and industrial uses.

Thus it is easy to recognise the definite and distinctive features contributing to the differences between this invention and prior inventions having clamping abilities. Further benefits and advantages will become apparent from a consideration of the ensuing description and drawings.

BRIEF DESCRIPTION OF THE DRAWINGS

FIG. 16 is a perspective view of a platform ready to receive the vise body as shown in FIG. 4.

FIG. 17 is a perspective view of the platform shown in FIG. 16 turned over exposing its underside.

FIG. 18 is a perspective view of the vise platform hinge pin with related parts.

FIG. 19 is a perspective view of a base ready to be mounted beneath the platform as shown in FIG. 16.

FIG. 20 is a perspective view of the base shown in FIG. 19 turned upside down exposing its underside.

FIG. 21 is perspective view of a clamping bar and related parts.

FIG. 22 is an exploded plan view of a latch pin and related parts resting within a cut-away portion of a housing.

DETAILED DESCRIPTION OF THE PREFERRED EMBODIMENTS

In machine shops the term way is normally understood as being a longitudinal strip used for guiding a moving part. The term carriage is normally understood as being a body mounted upon a way used to transport something. These terms are used repeatedly throughout the description.

Figure 1:
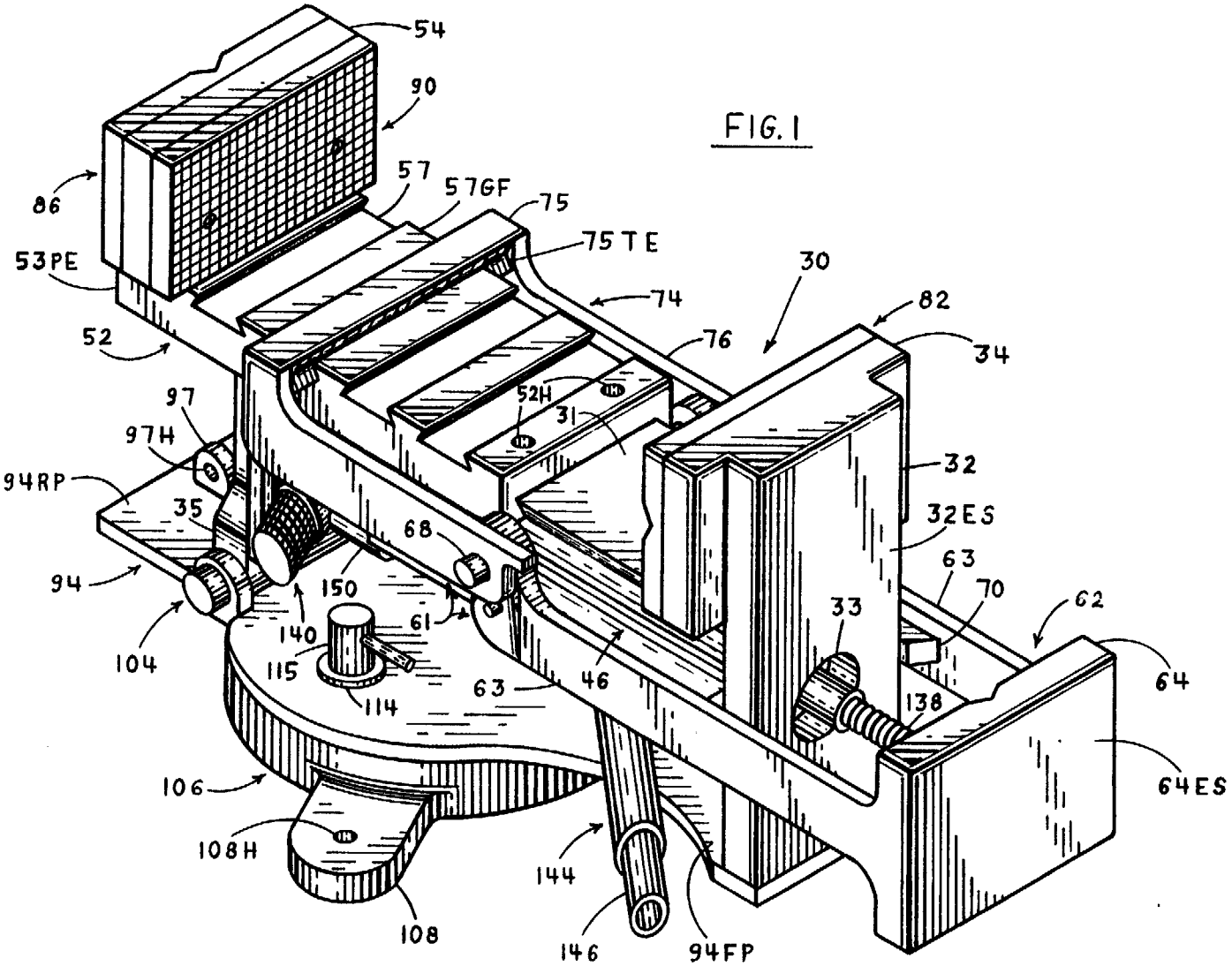
FIG. 1 is a perspective view of a vise with its body resting in a horizontal working position.

In reference to FIGS. 1,2,4, and 5 reference numeral 30 generally indicates a vise body according to the invention. FIG. 1 show vise body 30 resting in a horizonal (normal) working position. Unless otherwise indicated, terms indicating direction such as front and back are used to describe vise body 30 and related parts while they rest in the horizontal position.

Vise body 30 comprises a way 31, a front column 32, a front jaw 34, a rear column 35, and a jack housing 46 (FIGS. 7 and 8) which becomes part of vise body 30 during the manufacturing process. Way 31 is elongated, having a front portion and a rear portion; the front of way 31 being attached to front column 32. Front column 32 extends upward and downward from way 31 at right angles to way 31. Front jaw 34 is joined to an upper portion of front column 32, a front jaw pad mounting surface 34MS faces the rear of way 31. At the bottom of front column 32 is a latch pin housing 36 with a latch pin hole 38 and a protrusion 37, as will be explained. A hole 33 in front column 32 is for passage of a jack ram 138 partially illustrated in FIGS. 1 and 25. Located below way 31 near its rear is real column 35 which extend downward at right angles to way 31. Front column 32 and rear column 35 are at right angles to the longitudinal axis of way 31. Also incorporated into rear column 35 is an access passage 40, latch pin holes 38A and 38B and a protrusion 37A as will be explained.

Figures 3, 4, 5, 6:
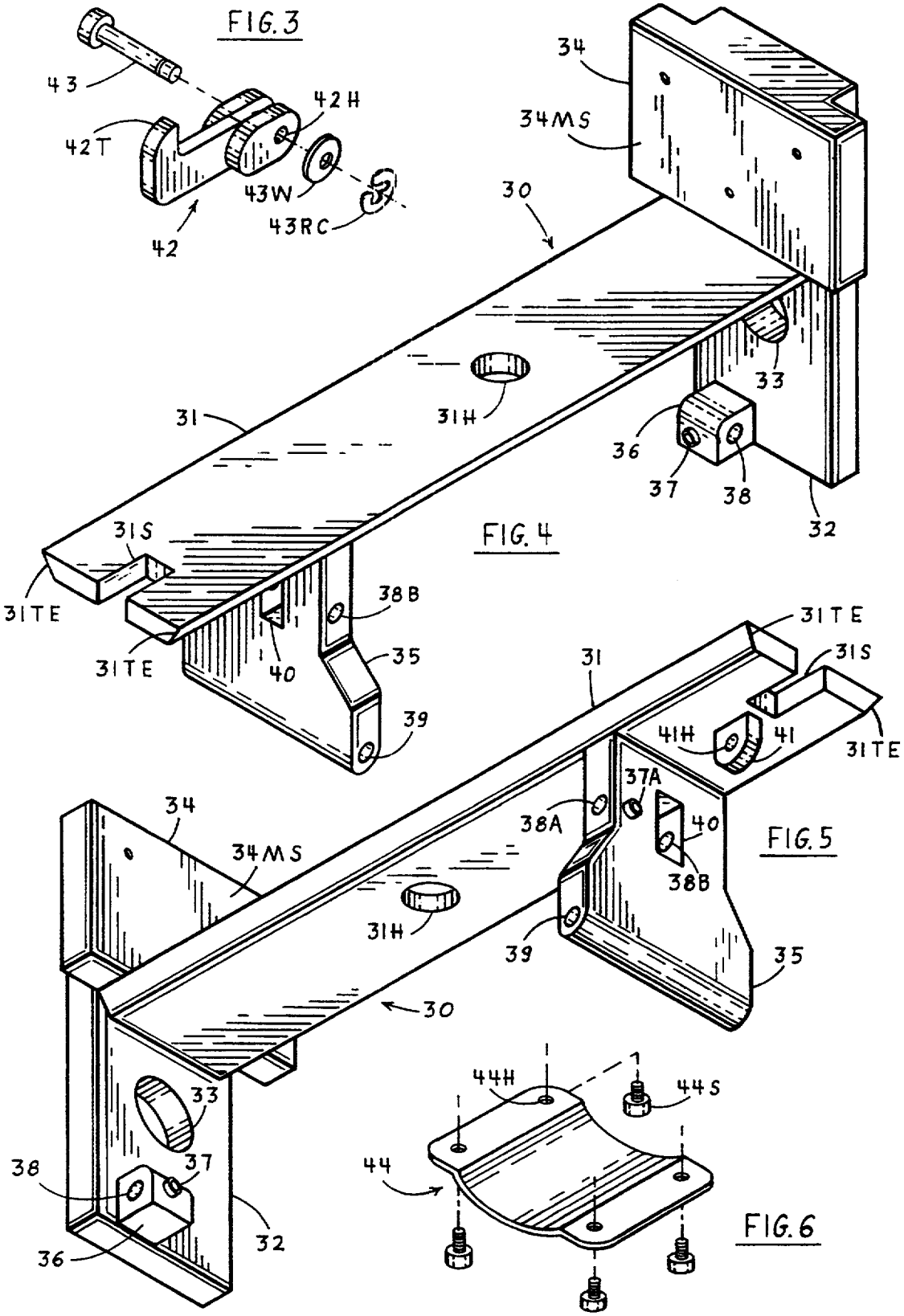
FIG. 3 is a perspective view of a safety catch with related parts.
FIG. 4 is a perspective view looking down on the main structural body of the vise.
FIG. 5 is a bottom perspective view of the vise body shown in FIG. 4.
FIG. 6 is a perspective view of a jack mounting bracket with screws.

On the rear underside of way 31 is a tab 41 with a hole 41H to receive a safety catch 42 (FIG. 3). A pin 43 is placed through two holes 42H on safety catch 42 and hole 41H on tab 41 and is secured by placing a typical washer 43W and a retainer clip 43RC over the end of pin 43. A slot 31S at the rear of way 31 is for passage of a tab 42T on safety catch 42.

Figure 7:
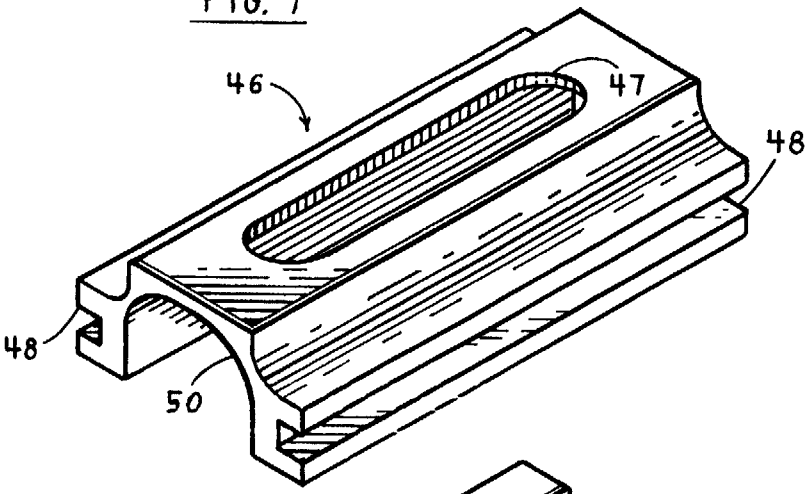
FIG. 7 is a perspective view of a jack housing which becomes part of the vise body.
Figure 8:
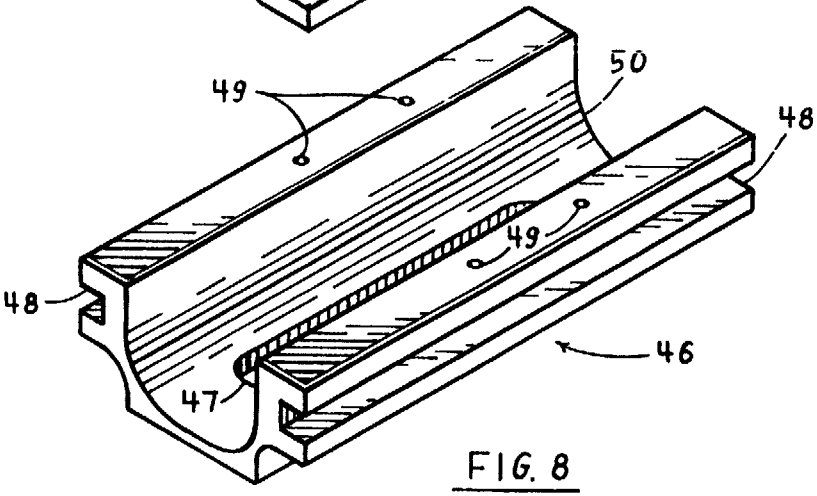
FIG. 8 is a perspective view of the jack housing shown in FIG. 7 turned upside down to expose its bottom.

Housing 46, as shown in FIG. 7. is elongated and attaches to the underside of way 31 with one end resting against front column 32 while the sides of houseing 46 are parallel with way 31 The top of housing 46 has an oblong opening 47 to allow it to be spot welded to the underside of way 31. Housing 46 also becomes a bed of support for maintaining rigidity of way 31. Housing 46 has a hollowed out portion 50 to receive placement of a hydraulic jack 150 partially shown in FIGS. 1 and 2. Hydraulic jack 150, its parts and function are a standard type used most commonly throughout the world. An example of hydraulic Jack 150 which may be used is a two ton version (serial number 93161094) distributed by Wilmar Corp., Box 24086, Seattle, WA. 98124. A hole 31H in way 31 is to allow access through opening 47 for servicing the oil level of jack 150 if necessary. FIG. 8 shows housing 46 turned upside down exposing its underside. Jack 150 is held in place by a jack mounting bracket 44 (FIG. 6) using four typical screws 44S placed through four holes 44H and screwed into four threaded bores 49 in the underside of housing 46. The sides of housing 46 have grooves 48 to receive a pair of tracking tongues 70 (FIG. 11) located along the inner faces of side arms 63 of front linking member 62.

Figure 9:
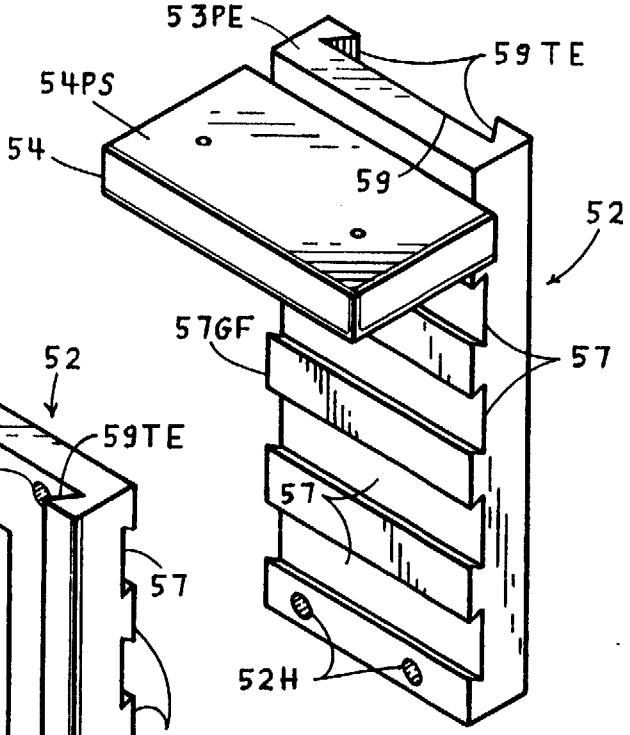
FIG. 9 is a perspective view of a carriage with a back jaw standing on its secondary end exposing the gripping formation of the top surface.
Figure 10:
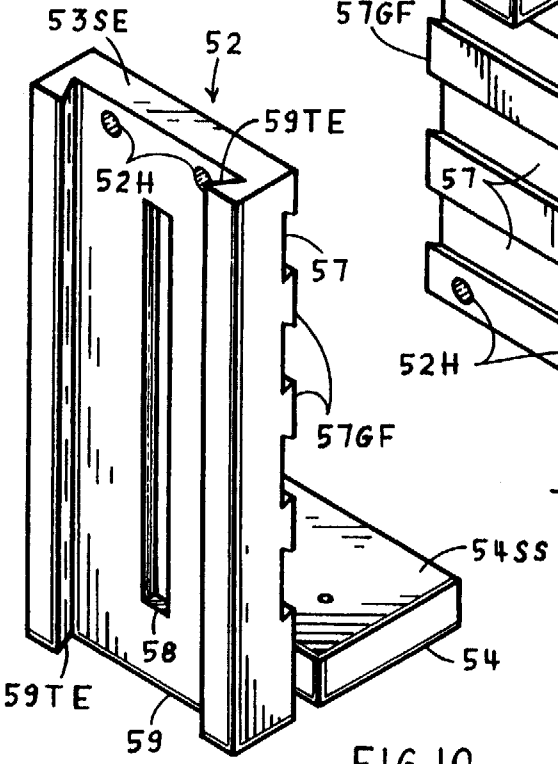
FIG. 10 is a perspective view of the carriage with the back jaw shown in FIG. 9 standing on its primary end exposing its underside.

FIGS. 9 and 10 show a carriage 52 which normally rests on way 31. Carriage 52 has a primary end 53PE and a secondary end 53SE. A back jaw 54 is mounted on carriage 52 at end 53PE. Back jaw 54 has a primary back jaw pad mounting surface 54PS facing end 53PE of carriage 52. Back jaw 54 also has a secondary back jaw pad mounting surface 54SS facing end 53SE of carriage 52. The remaining surface of carriage 52 has a series of gripping formations 57GF running across the width. These are separated by a series of dovetail slots 57. A wide dovetail shaped slot 59 is formed on the undersurface of carriage 52. It extends from end 53PE to end 53SE. Two tapered edges 59TE of dovetail slot 59 are mated to two tapered edges 31TE on way 31 to track carriage 52 on way 31. A slot 58 in the undersurface of carriage 52 is to accept tab 42T on safety catch 42.

Figure 11:
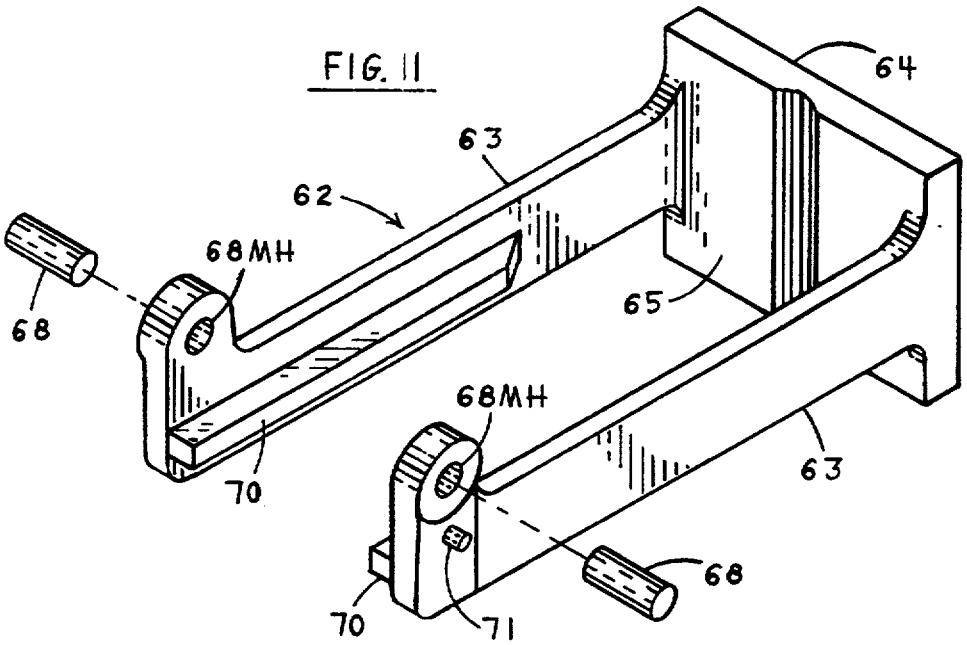
FIG. 11 is a perspective view of a front linking member with pins.
Figure 12:
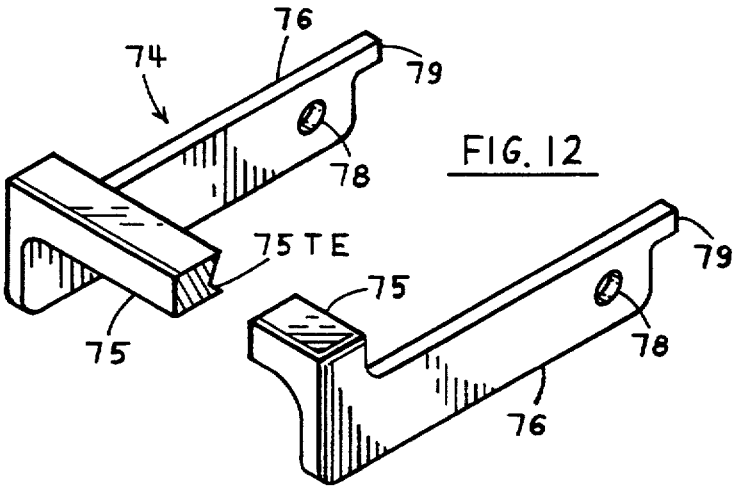
FIG. 12 is a perspective view of a rear linking member with a portion of its drawbar cut away.

A power transfer mechanism 61 (FIGS. 1 and 2) is comprised of front linking member 62 as shown in FIG. 11 and a rear linking member 74 as shown in FIG. 12. Front member 62 has a pad 64 whith side arms 63 extending rearward. Each arm 63 has a hinge pin mounting hole 68MH located at its rear portion. The inner surfaces of arms 63 have tracking tongues 70 mated to groves 48 of housing 46 as mentioned. Pad 64 has an interior surface 65 for receiving pressure from ram 138 of jack 150. Rear member 74 has a drawbar 75 having a tapered edge 75TE mated to grasp any gripping formation 57GF on carriage 52. Drawbar 75 also has a pair of side arms 76 which extend forward. Each arm 76 has a hole 78 at the front. Holes 78 are used to hinge attach arms 76 to arms 63 of front member 62. The hinge attachment is accompolished by the inner faces of drawbar arms 76 placed over the exterior faces on arms 63 of front member 62. Holes 78 on drawbar arms 76 are then aligned with holes 68MH on the rear portion of arms 63 of front member 62. A pair of hinge pins 68 are inserted through holes 73 and tightly pressed into holes 63MH. A pair of protrusions 79 on the front end of arms 76 come to rest against a pair of tabs 71 on arms 63 to stop drawbar 75 in an upright position when it is pivoted upward.

Figure 15:
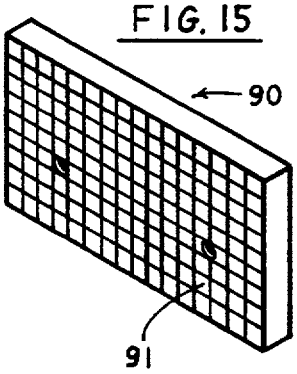
FIG. 15 is a perspective view of a secondary back jaw pad.
Figure 14:
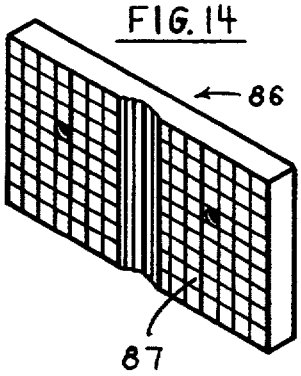
FIG. 14 is a perspective view of a primary back jaw pad.
Figure 13:
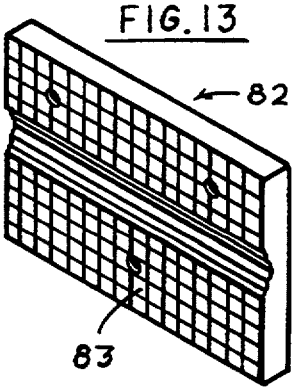
FIG. 13 is a perspective view of a front jaw pad.

FIG. 13 shows a front jaw pad 82 which will be mounted on surface 34MS of front jaw 34 using common screws. Pad 82 has a clamping surface 83 facing the rear of way 31. FIG. 14 a pad 86 to be mounted on primary surface 54PS of back jaw 54 using common screws. Pad 86 has a clamping surface 87 to face end 53PE of carriage 52. FIG. 15 shows a jaw pad 90 to be mounted on secondary surface 54SS of back jaw 54 using common screws. Pad 90 has a clamping surface 91 to face secondary end 53SE of carriage 52.

FIG. 16 shows the top surface of platform 94 on which vise body 30 rests. A pair of tabs 95 extend upward from the rearward sides of platform 94. Each contains a hole 95H. Vise body 30 is placed upon platform 94 with the bottom of front column 32 resting upon a front portion 94FP of platform 94. Rear column 35 of vise body 30 rests between tabs 95 on platform 94. A hinge pin 104 (FIG. 18) is then inserted through one hole 95H of one tab 95, through a hole 39 in the bottom of rear column 35, and through remaining hole 95H of remaining tab 95. A washer 104W and a retaining clip 104RC are then placed over the end of the pin 104 while also snapping retainer clip 104RC into a groove 104G on the end of hinge pin 104. A hole 96H in a tab 96 which extends upward from the front portion 94FP of platform 94 is used to secure front column 32 to platform 94. A tab 97 also extends upward from a rear portion 94RP of platform 94 and has a hole 97H for securing rear column 35. A hole 98 in platform 94 is to receive protrusion 37A from rear column 35. The longitudinal axis of platform 94 is parallel to vise body 30.

FIG. 17 shows the undersurface of platform 94. Two semi-circular protrusions 100 are separated by a slot 102. FIG. 19 shows a base 106 as it will be mounted to a table ready to receive platform 94. FIG. 20 shows the undersurface of base 106. Base 106 is basically round and has three protrusions 108. Each protrusion 108 has a hole 108H to allow mounting to a table. The bottom surface of base 106 has a bore 109 extending towards a top surface 106TS and stepping inward to form a smaller bore 107 extending through top surface 106TS. The inward step having a flat circular surface 110. In placing platform 94 upon base 106, protrusions 100 fit within bore 107 in top surface 106TS. Protrusions 100 keep platform 94 in alignment for rotating on base 106. Slot 102 is to receive a clamping bar 112 shown in FIG. 21. Two rounded ends 112RE of clamping bar 112 rotate within bore 109. Ends 112RE of clamping bar 112 clamps against circular surface 110 when platform 94 is tightened to base 106. With platform 94 in place, a pair of washers 114 are placed over a pair of threaded studs 113 of clamping bar 112 which protrude through a pair of holes 99 in platform 94. A pair of handles 115 have threaded bores which are screwed onto stud 113 for tightening platform 94 securely to base 106.

FIG. 22 shows a cutway view of latch pin housing 36 located on front column 32. A latch pin 116, having two cupped groves 117 and 117A formed around the outer surface, is also shown resting within hole 38. A head 116H is to grasp for manipulating pin 116 in or out of hole 38. A ball 118 is for snapping ointo grove 117 or 117A. A retainer bolt 119 has a bore in the center to retain a spring 120 which forcibly snaps ball 118 into grove 117 or 117A. The latching position of pin 116 is with ball 118 snapped into groove 117. Retainer bolt 119 rests within a threaded bore in protrusion 37 on the side of housing 36.

Identical parts as shown in FIG. 22 are also used as a latching means on rear column 35. The only exception being that rear column 35 is used as the housing to retain such parts whereby latch pin hole 38 is being designated as hole 38A and protrusion 37 is being designated as protrusion 37A on rear column 35 better shown in FIG. 5. FIG. 5 also shows housing 36 and rear column 35 before the placement of pins 116, balls 118, springs 120 and retainer bolts 119. Hole 38B on rear column 35 is for receiving the end of pin 116.

Figure 23:
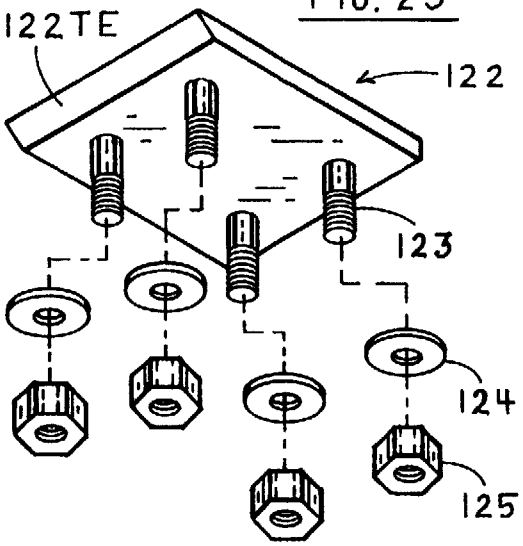
FIG. 23 is a bottom perspective view of an auxiliary rack mounting pad with typical washers and nuts.
Figure 24:
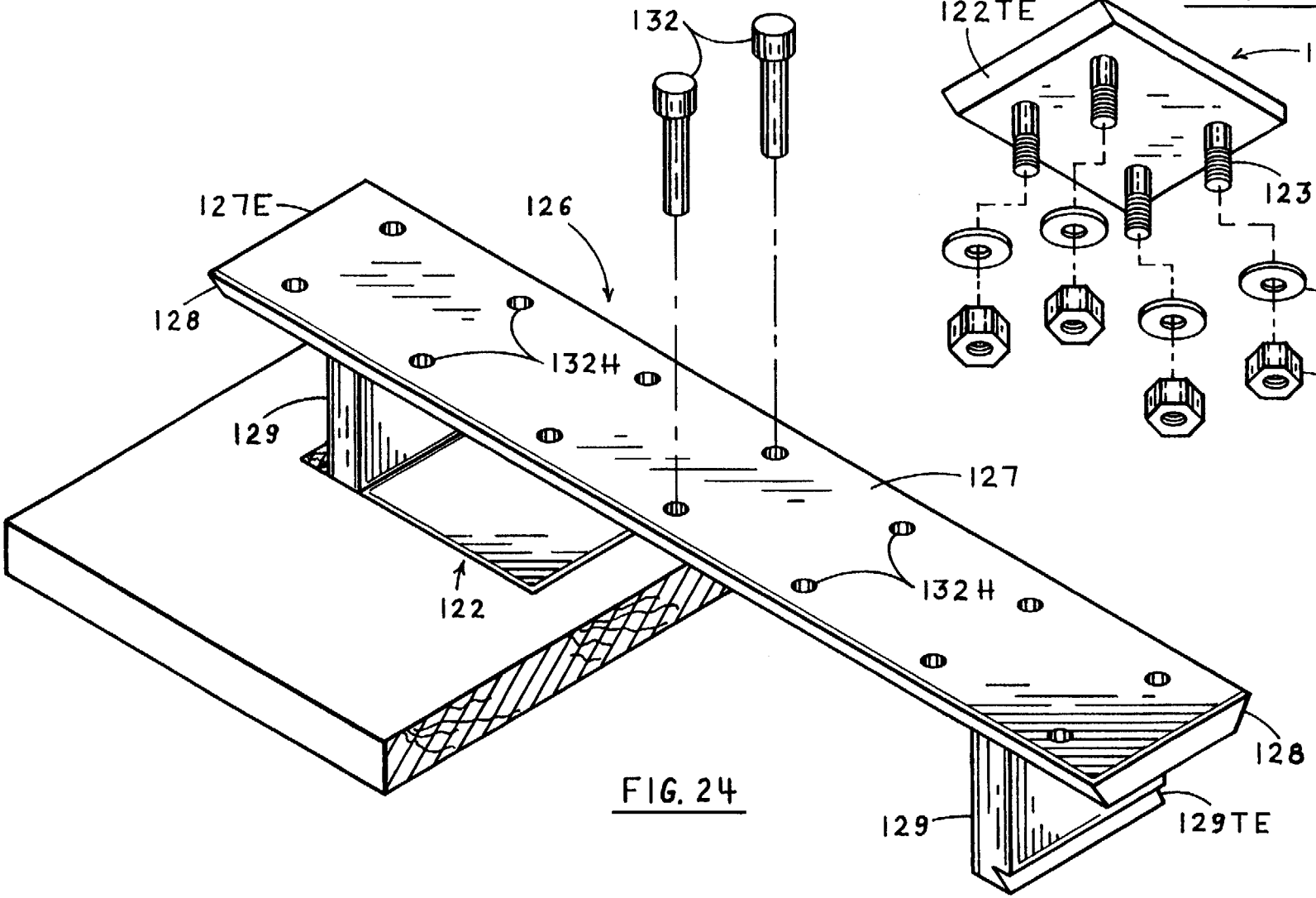
FIG. 24 is a perspective view of an auxiliary rack mounted to a partial section of a table.

FIG. 24 shows an auxiliary rack 126 with one end mounted to a cross-section portion of a table. Rack 126 is used to further expand clamping capacities from the vise. Rack 126 has an elongated way 127 supported by a column 129 at each end. Columns 129 extend downward at right angles to way 127. Both columns 129 have a tapered edge 129TE at the bottom which engages a tapered edge 122TE on a pair of mounting pads 122. FIG. 23 shows one of two pads 122 needed to secure rack 126. Pads 122 are designed to be mortised into the top surface of the table whicle four threaded studs 123 extend downward through four holes drilled withing the mortise. Four washers 124 and four nuts 125 are then placed over studs 123 for securing each pad 122. Placement of pads 122 are with their tapered edge 122TE facing the front of vise body 30. Pads 122 and rack 126 are to be mounted where a longitudinal axis of way 127 will be in line with the longitudinal axis of way 31 of vise body 30. An end 127E of way 127 faces exterior surface 64ES of pad 64 of front member 62. Way 127 has two tapered edges 128 mated to tapered edges 59TE on the bottom of carriage 52. A series of holes 132H are also placed in the surface of way 127. By removing carriage 52 from way 31 of vise body 30 and placing it on way 127, two holes 52H (FIGS. 1, 9 and 10) on carriage 52 can be aligned with holes 132H in way 127. A pair of pins 132 secures carriage 52 to way 127 by being placed through holes 52H and 132H. Exterior surface 64ES (FIG. 1) of pad 64 of front member 62 now becomes a clamping surface. Clamping occurs between surface 64ES and either pad clamping surface 87 or 91 on back jaw 54 depending on the directional placement of carriage 52 upon way 127. Carriage 52 also being reversible upon way 127.

Figure 2:
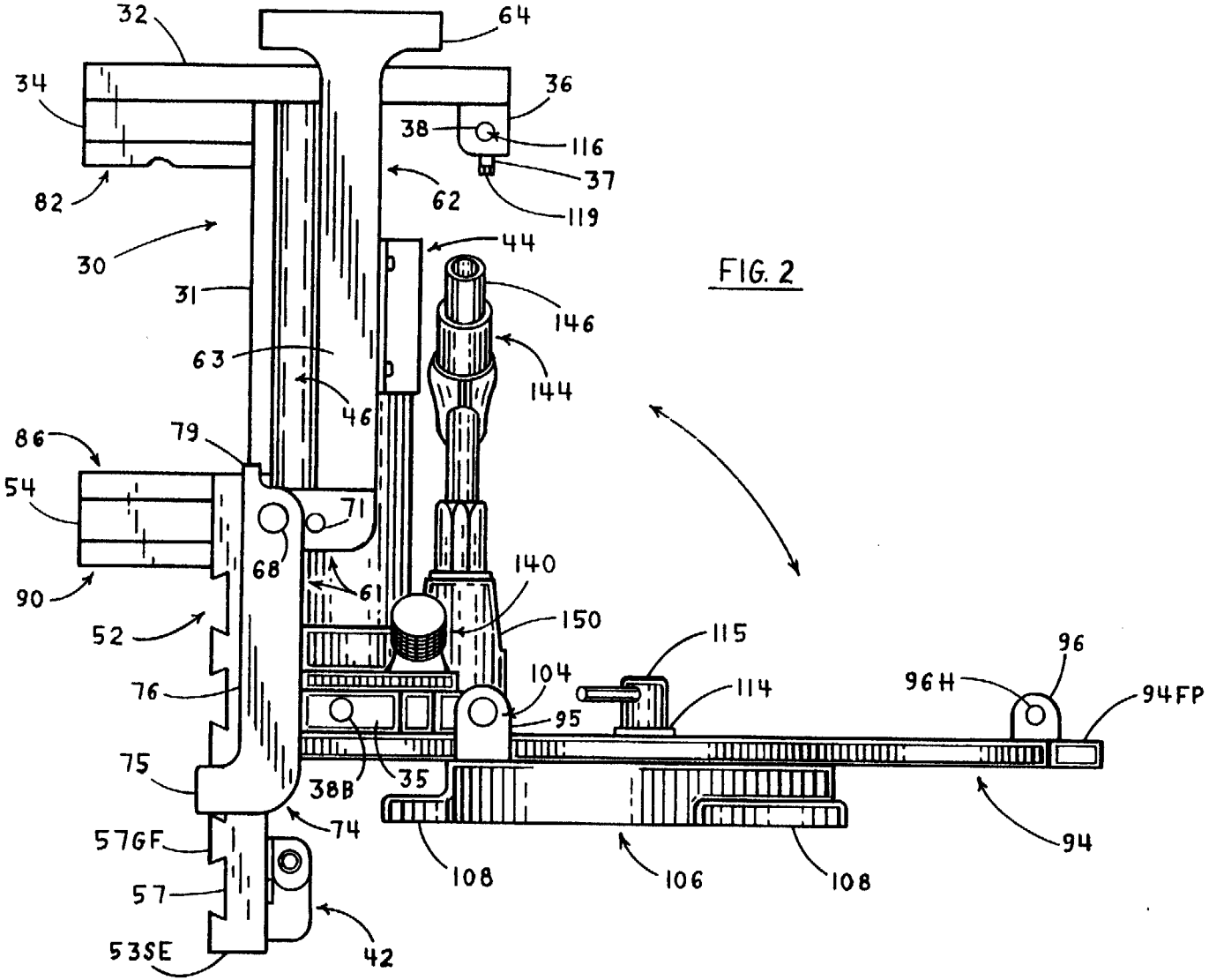
FIG. 2 is a side view of the vise with its body pivoted upward to a vertical working position.
Figure 25:
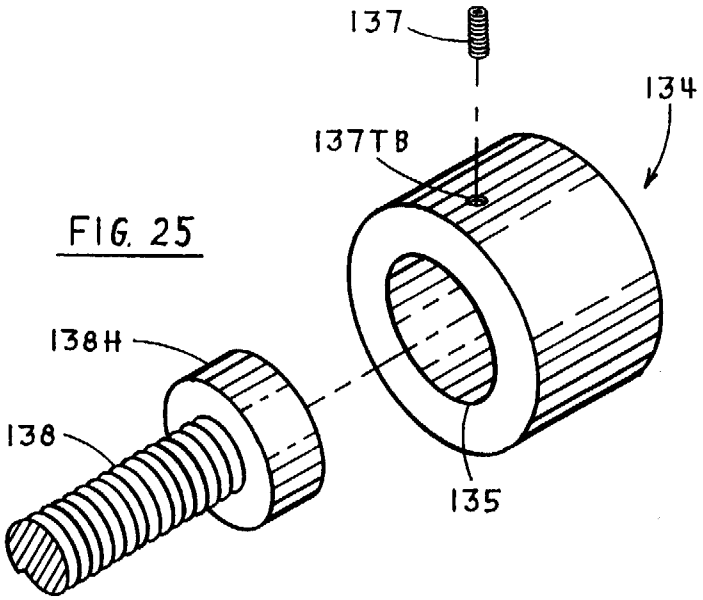
FIG. 25 is an exploded perspective view of an accessary head and a portion of a jack ram with a head on which it mounts.
Figure 26:
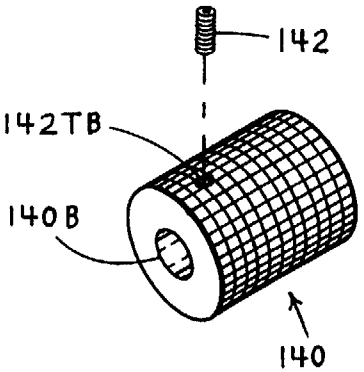
FIG. 26 is an exploded perspective view of a hydraulic jack accessary knob.
Figure 27:
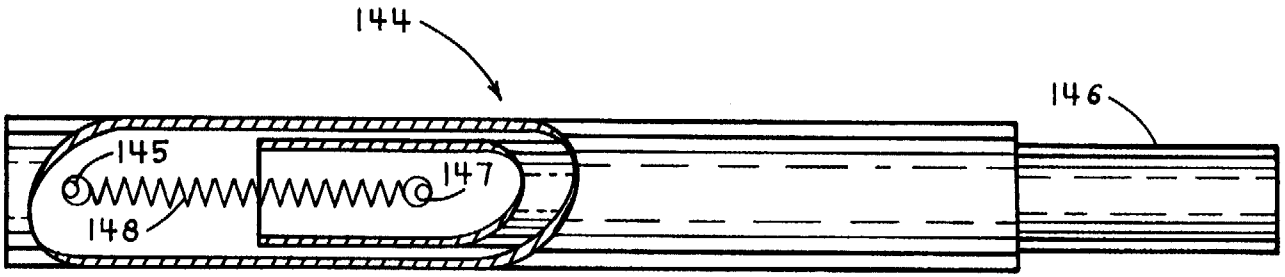
FIG. 27 is an exploded perspective view of a hydraulic jack accessary handle with a section cut out to expose its parts.

Accessary parts shown in FIGS. 25, 26, and 27 are designed to be used with jack 150 partially illustrated in FIGS. 1 and 2. FIG. 25 shows an accessary head 134 and a partial view of ram 138 with a head 138H used to apply pressure from jack 150. A bore 135 in head 134 is to receive head 138H of ram 138 being secured by an allen screw 137; screw 137 being screwed into a threaded bore 137TB in head 134 and tightened accordingly. FIG. 26 shows an accessary knob 140 having a bore 140B to be placed on the stem of the pressure release valve of jack 150. An allen screw 142 is then screwed into a threaded bore 142TB in knob 140 and tightened accordingly. FIG. 27 shows a cut-away view of an accessary handle 144 with an extendable tube 146 resting within. Handle 144 is designed to be placed into the socket used to manipulate the pump of jack 150. A pin 145 passes through holes drilled near the end of handle 144 to retain one end of a spring 148. A pin 147 also passes through a hole drilled in tube 146 to retain the other end of spring 148. Tube 146 can be pulled out to increase leaverage while manipulating the pump of jack 150. When tube 146 is released it will be retracted back into handle 144.

Base 106 should be mounted near the edge of the table surface for vise body 30 to be pivoted upward to the vertical working position. It is also desirable, but not necessary, to have base 106 mounted near the front edge of the table while having the corner of the table rounded. This will allow vise body 30 to be rotated to face the front of the table when desired.

With vise body 30 resting inthe horizontal position, latch pin 116 of front column 32 can be inserted into hole 96H of tab 96. This secures front column 32 to platform 94. Jack ram 138 should now be retracted to where the pushing surface of its head 134 is flush with an exterior surface 32ES of front column 32. Tongues 70 from front member 62 can now be inserted into grooves 48 along the sides of housing 46. This is easily preformed while rear member 74 is pivoted to the upright position so that drawbar 75 can pass over front jaw 34. Side arms 63 of front member 62 are now pushed rearward until surface 65 of pad 64 comes to rest against exterior surface 32ES of front column 32.

Operation of the vise may begin when all parts relating to the vise are placed in their appropriate positions. A normal clamping position is derived when carriage 52 is slid onto way 31 with end 53PE of carriage 52 facing front jaw 34. Drawbar 75 of rear member 74 can now be placed over back jaw 54. Partial adjustment of back jaw 54 in relation to front jaw 34 is achieved by placing tapered edge 75TE of drawbar 75 to grasp any gripping formation 57GF on carriage 52. Drawbar 75 may also be placed to grasp behind end 53SE of carriage 52.

To clamp a workpiece, it should be placed between and in contact with pad 82 of front jaw 34 and primary pad 86 of back jaw 54 while adjusting drawbar 75 to an appropriate gripping formation 57GF on carriage 52. This normally leaves a space between surface 65 of pad 64 and exterior surface 32ES of front column 32. The appropriate gripping formation 57GF normally being the one which will leave the least possible space between pad 64 and front column 32. By manipulating handle 144 of jack 150, ram 138 is projected forward until accessary head 134 comes in contact with pad 64. Further pressure is then applied until the workpiece is adequately held. The workpiece may be removed by turning accessary knob 140 to relieve the hydraulic pressure. Ram 138 is easily retracted by manually applying pressure to exterior surface 64ES of pad 64 which also retracts front member 62 and rear member 74. This method is used when ram 138 needs to be retracted.

An extended clamping position is derived by reversing carriage 52 on way 31 while having end 53SE of carriage 52 facing front jaw 34. Drawbar 75 can either be placed to grasp behind back jaw 54 at end 53PE or to grasp any gripping formation 57GF on carriage 52 as shown in FIG. 1. Workpieces are now held between pad 90 of back jaw 54 and pad 82 of front jaw 34. The workpiece clamping and removal procedures are the same as mentioned before.

An optional workpiece holding position can be obtained between accessary head 134 of ram 138 and surface 65 of pad 64. With a workpiece placed in this position, either end 53PE or 53SE of carriage 52 is placed against front jaw pad 82 while placing drawbar 75 to grasp a desired gripping formation 57GF or gripping position on carriage 52. This gripping placement being the one which will leave the least space between accessary head 134 and the workpiece. The workpiece clamping and removal procedures are as usual. Workpieces can also be clamped in unison between front jaw 34 and back jaw 54 and between accessary head 134 and pad 64.

Workpieces can be held in any of the described manners whether vise body 30 rests in the horizontal or vertical position. To pivot vise body 30 to a vertical position, latch pin 116 of front column 32 is disengaged from hole 96H of tab 96. By raising the front of vise body 30, the rear surface of rear column 35 comes to rest upon the rear portion 94RP of platform 94. Latch tab 97 now rests within access passage 40 on rear column 35. Latch pin 116 of rear column 35 can now be pushed through hole 97H of tab 97 and into hole 38B on rear column 35. This latching procedure is to retain vise body 30 securely in the vertical operational position. While in this position, gravity will engage tab 42T of safety catch 42 into slot 58 on the bottom of carriage 52 to prevent carriage 52 from accidently falling from way 31. Gravity also disengages tab 42T when vise body 30 is returned to the horizontal position.

Vise body 30 and platform 94 can be fully rotated upon base 106 while they rest in the horizontal position. This is done by loosening handles 115 as shown in FIGS. 1 and 2. As mentioned before, rounding the corner of the table will allow vise body 30 to be partially rotated while resting in the vertical position, however, by mounting base 106 upon a pedestal full rotation could be achieved.

SUMMARY, RAMIFICATIONS AND SCOPE

Accordingly this present invention relates to a vise having a vise body comprising a way supported by a front and a rear column. The front column backs a fixed front jaw at the top. The way is to track a carriage having a back jaw mounted at one end. The carriage is reversible upon the way while the back jaw has opposing clamping surfaces. Placement of the carriage upon the way while the back jaw is at the rear gives the greatest clamping capacities. The clamping surface of the back jaw to be used depends upon the directional placement of the carriage. A hydraulic jack having a ram is located beneath the way for supplying a power source to the front exterior of the vise body. The power is then transferred rearward to the carriage by a power transfer mechanism which in turn pulls the carriage and back jaw towards the front jaw. The vise body is capable of being tilted upward to a vertical position on its rear end to change workpiece positions. The vise body rests on a platform which is mounted and can pivot on a base. An auxiliary rack may also be anchored to a table in front of the vise to retain a clamping surface which allows the vise to hold elongated objects.

Previous vises using a vise screw or a cylinder-piston usually have one feature in common; their maximum clamping capacities are normally very small in proportion to the overall length of their body. To overcome this problem a different approach had to be applied to the basic design. Part of the different approach is derived by supplying power to the front of the vise and transferring it to the rear. This allows for other design features to take place; one being, by mounting a backjaw at one end of a carriage with gripping formations and having the carriage slidable and reversible upon a way. This allows the clamping capacities to be substantially increased or decreased very quickly. The feature of having the vise body hinge mounted to a platform which can rotate upon a base adds further flexibility. With these combined features you obtain an exceptionally versatile vise. As a result this vise can achieve clamping capacities which are larger than its body length even without use of the auxiliary rack. The reader may find other useful features by reviewing the description.

While my description contains many specificities, this should not be construed as limitations to the scope of the invention but rather as an illustration of the devices versatility. Many other variations are possible, for example: a hydraulic jack has been used in this invention to supply power for clamping. This source of power was selected because hydraulic jacks are commonly available and extremely powerful while also being inexpensive to purchase. By using a hydraulic jack already in production, the cost of manufacturing the vise can be reduced. It is also reasonable to assume that a screw operated jack, a cylinder piston devise of other design, or other devises could adequately be adapted to the vise body for the purpose of supplying power. Another variation could be a differently designed power transfer mechanism or a back jaw carriage which is also adjustable.

Accordingly, the scope of the invention should be determined not by the embodiments illustrated but by the appended claims and their legal equivalents.

What is claimed is:

1. A vise comprising:

a vise body having a way, a front portion of said way being supported by a front column, a rear portion of said way being supported by a rear column, a front jaw being attached to a top portion of said front column while having a clamping surface facing the rear of said way, a carriage having a back jaw, the bottom of said carriage having a tracking means for sliding upon said way, said carriage having an adjustment means for adjusting the distance between said back jaw and said front jaw, a power means being attached to the under side of said way, said power means having a ram to project through an opening in said front column, thus supplying a power source at the front exterior of said front column, a power transfer mechanism for connecting said power source to said carriage, said power transfer mechanism having a pad, said pad being positioned at the front exterior of said front column, said pad for receiving pressure from said ram, said pad having side arms to extend rearward along the sides of said vise body to connect to a drawbar, said side arms having a slidable attachment means of being tracked along the sides of said vise body, said drawbar being engageable with said adjustment means on said carriage, whereby said back jaw is drawn forward when pressure is applied to said pad.

2. A vise according to claim 1, further comprising a platform to support said front column and said rear column of said vise body, attaching the underside of said rear column to rear portion of said platform by means of a hinge allowing said vise body to pivot upward to a vertical position.

3. A vise according to claim 2, whereby said platform has an attachment means for being secured to a table.

4. A vise comprising:

a vise body having a way connecting a front column of support and a rear column of support, a housing attached to the bottom of said way, said housing having a groove along each side extending its full length, said front column and said rear column being at right angle to said way, said front column extending upward and downward from the front of said way, a front jaw joined to the top of said front column and having a jaw pad with a clamping surface facing the rear of said way, said rear column extending downward from a rear portion of said way, a platform to support said front column and said rear column of said vise body, a hinging means of attaching the bottom of said rear column to a rear portion of said platform with a hinge to allow said vise body to pivot upward to a vertical position, a carriage having a back jaw mounted on one end called the primary end, said back jaw having opposing jaw surfaces, each said jaw surface having a pad, each said pad having a clamping surface, the upper surface of said carriage having a series of gripping formations, the underside surface of said carriage having a tracking means for sliding on said way, whereby normal workpiece holding capacities are obtained while the primary end of said carriage faces said front jaw, thus by reversing said carriage upon said way the workpiece holding capacities can be substantially increased, a hydraulic jack retained within said housing of said vise body, said hydraulic jack having a ram with a head to project through an opening in said front column supplying a power source at the front exterior of said vise body, a power transfer mechanism comprising a front linking member and a rear linking member, said front member having a pad for receiving pressure from said head of said ram, said pad having a pair of side arms to extend rearward along the sides of said housing while being mated to slide along said grooves on the sides of said housing, said side arms of said pad are connected by a hinge to a pair of side arms of a drawbar, said drawbar being mated to engage any gripping formation on said carriage, said gripping formations allowing adjustment of said carriage upon said way, whereby said carriage and said back jaw is drawn toward said front jaw when pressure is applied to said pad.

5. A vise according to claim 4, wherein said front column has an engagable latching means for securing said vise body while resting in a normal horizontal position, said rear column also having an engagable latching means for securing said vise body while resting in the vertical position.

6. A vise according to claim 5, wherein said platform has a base, said platform also having a swiveling means for rotating upon said base, said base having a clamping means for securing said platform to prevent rotation whenever desired, said base also being mountable to a table.

7. A vise according to claim 4, wherein said pad of said front linking member has a clamping surface facing said front column, said head of said ram having a clamping surface facing said pad, whereby workpieces can be held beyond the front exterior of said vise body.

8. A vise according to claim 7, further comprising hydraulic jack accessories including a handle, an accessory head, and a pressure release knob, said knob being attachable to a pressure release portion of said hydraulic jack, said knob having an outer perimeter with gripping serrations to insure ease of grasping whereby by turning said knob the hydraulic pressure may be relieved within said hydraulic jack, said handle being attachable to a portion of said hydraulic jack which increases hydraulic pressure when manipulated back and forth, whereby by manipulating said handle hydraulic pressure is increased within said hydraulic jack to force said ram forward, said handle also having a spring retractable extension tube which may be pulled out to insure ease of manually manipulating said handle, said accessory head to be mounted over said head of said ram, said accessory head having an increased clamping surface to better accommodate workpieces.

9. A vise according to claim 4, further comprising a safety catch mounted to the bottom rear portion of said way, said safety catch can be engaged by said carriage to prevent said carriage from sliding off said way when said vise body is pivoted upward to the vertical position.

10. A vise according to claim 4, further comprising an auxiliary rack having an elongated way which can also be used to track said carriage, said auxiliary rack being mountable to a table while having a longitudinal axis aligned with the longitudinal axis of said vise body, placement of said rack being in front of said vise body, said auxiliary rack having an adjustable securing means for securing said carriage upon said elongated way, whereby an optional yet variable workpiece holding location is created between said back jaw and the exterior surface of said pad of said front linking member.

11. A vise comprising:

a vise body having a way connecting a front column and a rear column, a housing attached to the bottom of said way, said front and rear columns being at right angle to said way, said front column extending upward and downward from the front of said way, a front jaw joined to the top of said front column, said front jaw having a clamping surface facing the rear of said way, said rear column extending downward from a rear portion of said way, a platform to support said front column and said rear column of said vise body, a carriage having a back jaw mounted on one end, said back jaw having opposing clamping surfaces, said carriage having a series of gripping formations, the underside of said carriage having a tracking means for sliding on said way, said carriage being reversible on said way, thus be reversing said carriage on said way workpiece holding capacities can be substantially increased, a power means retained within said housing of said vise body, said power means having a ram with a head to project through an opening in said front column, thus supplying a power source at the front exterior of said vise body, a power transfer mechanism comprising a front linking member and a rear linking member, said front member having a pad for receiving pressure from said head of said ram, said pad having a pair of side arms extending rearward along the sides of said housing, said side arms of said pad having a tracking means mated to slide along the sides of said housing, said side arms of said pad are hinged to a pair of side arms of a drawbar, said drawbar being mated to grasp any said gripping formation on said carriage, said gripping formations allowing adjustment of said carriage upon said way, whereby said carriage and said back jaw is drawn toward said front jaw when pressure is applied to said pad.

12. A vise according to claim 11, wherein said rear column has a hinging means for attaching the bottom of said rear column to a rear portion of said platform, said hinging means to allow said vise body to pivot upward to a vertical position.

13. A vise according to claim 12, wherein said front column has an engagable latching means for securing said vise body while resting in a normal horizontal position, said rear column also having an engagable latching means for securing said vise body while resting in the vertical position.

14. A vise according to claim 13, wherein said platform has a base, said platform also having a swiveling means for rotating upon said base, said base having a clamping means for securing said platform to said base, said base being mountable to a table.

15. A vise according to claim 11, wherein said pad of said front linking member has a clamping surface facing said front column, said head of said ram having a clamping surface facing said pad, whereby workpieces can be held at the front exterior of said vise body.

16. A vise according to claim 15, wherein said power means is a hydraulic jack, said ram being retractable by manually applying pressure to the exterior front surface of said pad while the hydraulic pressure is relieved within said hydraulic jack.

17. A vise according to claim 16, further comprising hydraulic jack accessories including a handle, an accessory head, and a pressure release knob, said knob being attachable to a pressure release portion of said hydraulic jack, said knob having an outer perimeter with gripping serrations to insure ease of grasping whereby by turning said knob the hydraulic pressure may be relieved within said hydraulic jack, said handle being attachable to a portion of said hydraulic jack which increases hydraulic pressure when manipulated back and forth, whereby by manipulating said handle hydraulic pressure is increased within said hydraulic jack to force said ram forward, said handle also having a spring retractable extension tube which may be pulled out to insure ease of manually manipulating said handle, said accessory head to be mounted over said head of said ram, said accessory head having an increased clamping surface to better accommodate workpieces.

18. A vise according to claim 11, further comprising a front jaw pad, two back jaw pads, and a safety catch, said safety catch having an engagement means for preventing said carriage from accidentally sliding off said way when said vise body is pivoted upward to the vertical position, said back jaw pads being mountable to the oppositely facing clamping surfaces of said back jaw, said front jaw pad being mountable to the clamping surface of said front jaw.

19. A vise according to claim 11, further comprising an auxiliary rack having an elongated way which will accept said carriage, said auxiliary rack being mountable to a table while having a longitudinal axis aligned with a longitudinal axis of said vise body, placement of said rack being in front of said vise body, said rack having an adjustment means of securing said carriage upon said way, whereby an optional yet variable workpiece holding location is created between said back jaw and the exterior surface of said pad of said front linking member.

20. A vise according to claim 11, wherein said power means is a hydraulic jack, said ram being retractable by manually applying pressure to the front exterior surface of said pad while the hydraulic pressure is relieved within said hydraulic jack.

* * * * *